US009746875B2

(12) United States Patent
Gyotoku et al.

(10) Patent No.: US 9,746,875 B2
(45) Date of Patent: Aug. 29, 2017

(54) TICKET PRODUCTION DEVICE AND TICKET PRODUCTION METHOD

(71) Applicant: SEIKO EPSON CORPORATION, Tokyo (JP)

(72) Inventors: Yasuhiro Gyotoku, Matsumoto (JP); Katsuyuki Endo, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/091,276

(22) Filed: Nov. 26, 2013

(65) Prior Publication Data

US 2014/0148335 A1 May 29, 2014

(30) Foreign Application Priority Data

Nov. 26, 2012 (JP) ..... 2012-257166

(51) Int. Cl.

| | |
|---|---|
| ***B41J 11/66*** | (2006.01) |
| ***G06C 29/00*** | (2006.01) |
| ***B41M 5/30*** | (2006.01) |
| ***B41J 3/407*** | (2006.01) |
| ***B41J 11/70*** | (2006.01) |

(52) U.S. Cl.

CPC ..... *G06C 29/00* (2013.01); *B41J 3/4075* (2013.01); *B41J 11/663* (2013.01); *B41J 11/703* (2013.01); *B41M 5/30* (2013.01)

(58) Field of Classification Search

CPC ..... G06C 29/00; B41J 11/003; B41J 11/0095; B41J 3/14

See application file for complete search history.

(56) References Cited

U.S. PATENT DOCUMENTS 4,319,132 A * 3/1982 Guibord et al. ..... 235/379
4,340,150 A * 7/1982 Guibord et al. ..... 221/21
5,222,818 A 6/1993 Akiyama et al.
(Continued)

FOREIGN PATENT DOCUMENTS

CN 202702888 U 1/2013
EP 2735448 A1 5/2014
(Continued)

OTHER PUBLICATIONS

Extended European Search Report issued Mar. 14, 2014 corresponds to European Patent application No. 13193592.6.

*Primary Examiner* — David Banh
(74) *Attorney, Agent, or Firm* — Hauptman Ham, LLP

(57) ABSTRACT

A ticket production device that cuts continuous recording paper printed with information and produces a ticket includes a paper conveyance means that conveys the recording paper through a paper conveyance path; a printing means that prints information on the recording paper conveyed by the paper conveyance means; a paper cutting means that cuts the recording paper on which information was printed into a ticket of a specific length; a paper position detection means that detects the position of the recording paper waiting at a paper exit; and a control means that integrally controls these other means. When the paper position detection means detects the position of the recording paper changed, the control means operates the paper cutting means and produces a ticket based on the detection result from the paper position detection means.

19 Claims, 6 Drawing Sheets

(56) References Cited

U.S. PATENT DOCUMENTS

| | | | | |
|---|---|---|---|---|
| 5,478,161 | A * | 12/1995 | Suzuki et al. | 400/582 |
| 5,588,762 | A * | 12/1996 | Suzuki | 400/582 |
| 5,921,686 | A | 7/1999 | Baird et al. | |
| 6,056,460 | A | 5/2000 | Suzuki | |
| 6,129,462 | A | 10/2000 | Furuya et al. | |
| 6,129,466 | A | 10/2000 | Suzuki | |
| 6,353,479 | B1 | 3/2002 | Lubawy et al. | |
| 2002/0046196 | A1 | 4/2002 | Ogg | |
| 2002/0164185 | A1 | 11/2002 | Horiuchi et al. | |
| 2004/0041018 | A1 | 3/2004 | Silverbrook et al. | |
| 2005/0204941 | A1* | 9/2005 | McNeil | B26D 5/32 101/226 |
| 2005/0270556 | A1 | 12/2005 | Shimamura | |
| 2006/0210344 | A1 | 9/2006 | Montagutelli | |
| 2007/0258748 | A1 | 11/2007 | Moriyama et al. | |
| 2008/0062458 | A1 | 3/2008 | Inui | |
| 2008/0074713 | A1 | 3/2008 | Nakawaki | |
| 2008/0229892 | A1 | 9/2008 | Campanini | |
| 2008/0231898 | A1 | 9/2008 | Iwanaga et al. | |
| 2008/0310901 | A1 | 12/2008 | Michon | |
| 2009/0190170 | A1 | 7/2009 | Yoshie | |
| 2009/0245914 | A1 | 10/2009 | Shibasaki et al. | |
| 2009/0288776 | A1 | 11/2009 | Shimosato et al. | |
| 2010/0157362 | A1 | 6/2010 | Oomura | |
| 2011/0081190 | A1 | 4/2011 | Kan et al. | |
| 2011/0085840 | A1* | 4/2011 | Shiohara | 400/578 |
| 2012/0039651 | A1 | 2/2012 | Yamaguchi et al. | |
| 2012/0194850 | A1 | 8/2012 | K. et al. | |
| 2013/0233913 | A1 | 9/2013 | Inoue et al. | |
| 2014/0148335 | A1 | 5/2014 | Gyotoku et al. | |
| 2014/0197268 | A1 | 7/2014 | Zhang et al. | |
| 2015/0259171 | A1 | 9/2015 | Campanini | |

FOREIGN PATENT DOCUMENTS

| | | | |
|---|---|---|---|
| JP | 1-118461 | A | 5/1989 |
| JP | 4-331169 | A | 11/1992 |
| JP | 5-42731 | A | 2/1993 |
| JP | 5-308464 | A | 11/1993 |
| JP | 6-218999 | A | 8/1994 |
| JP | 7-228016 | A | 8/1995 |
| JP | 9-142431 | A | 6/1997 |
| JP | 2004-118625 | A | 4/2004 |
| JP | 2004268207 | A | 9/2004 |
| JP | 2004-345253 | A | 12/2004 |
| JP | 2006-4160 | A | 1/2006 |
| JP | 2007-181975 | A | 7/2007 |
| JP | 2008-62542 | A | 3/2008 |
| JP | 2008-234481 | A | 10/2008 |
| JP | 2008-238745 | A | 10/2008 |
| JP | 2009-178886 | A | 8/2009 |
| JP | 2010-778 | A | 1/2010 |
| JP | 2011-51252 | A | 3/2011 |
| JP | 2011-79215 | A | 4/2011 |
| JP | 2013-39736 | A | 2/2013 |
| WO | 95/22445 | A1 | 8/1995 |
| WO | 2012/066837 | A1 | 5/2012 |

* cited by examiner

TICKET PRODUCTION DEVICE AND TICKET PRODUCTION METHOD

RELATED APPLICATIONS

The present application is based on, and claims priority from, Japanese Application Number 2012-257166, filed Nov. 26, 2012, the disclosure of which is hereby incorporated by reference herein in their entirety.

BACKGROUND

1. Technical Field

The present disclosure relates to a ticket production device that produces tickets on which information is printed, and a ticket production method.

2. Related Art

Receipts, coupons, tags, and other types of tickets are used in many fields, including sales and distribution. Printers with an automatic cutter are used as a ticket production device that produces such tickets. Such printers print information on continuous recording paper and then sequentially cut the recording paper to a specific length to produce the tickets. The automatic cutter is located at the downstream end of the conveyance path passing the printing position to the paper exit. The cut ticket is then manually removed by the operator and handed to the customer (see, for example, JP-A-2004-268207).

However, if the operator does not take the ticket at the right time when using the printer described above, the printed tickets may accumulate in the paper exit or fall away from the paper exit. If tickets accumulate, the accumulated tickets can interfere with the cutting edge of the automatic cutter, possibly resulting in cutting problems or the accumulated tickets being recut into small pieces, adversely effecting printer operation. If the tickets fall out, they can be lost or distributed incorrectly.

SUMMARY

The present disclosure is directed to solving at least part of the foregoing problem, and can be achieved as described in the following embodiments and examples.

In one embodiment of the disclosure, a ticket production device that cuts and issues continuous recording paper on which information is printed as a ticket from a paper exit includes: a paper conveyance means that conveys the recording paper through a paper conveyance path; a print means that prints information on the recording paper conveyed by the paper conveyance means; a paper cutting means that cuts the recording paper printed with information into a ticket of a specific length; a paper position detection means that detects change in the position of the recording paper waiting at the paper exit; and a control means that integrally controls each of the other means; the paper position detection means detecting that the position of the recording paper changed, and the control means operating the paper cutting means and producing the ticket based on the detection result of the paper position detection means.

In one embodiment of the disclosure, the ticket production device can pause recording paper printed with information at the paper exit, and when the operator raises the recording paper and changes the position of the recording paper intending to issue a ticket, the ticket production device can detect a change in the position of the recording paper via the paper position detection means. The ticket production device can then cut the recording paper to make a ticket based on the detection result from the paper position detection means. Tickets can therefore be produced one at a time when the operator issues a ticket. As a result, any issued tickets accumulating at the paper exit or falling out of the paper exit can be reduced.

In another embodiment of the disclosure, the paper position detection means of the foregoing ticket production device detects change in the position of the recording paper at least in a direction intersecting the conveyance direction of the recording paper.

In this configuration, the paper position detection means can detect the recording paper moving in a direction intersecting the conveyance direction of the recording paper, which is the operation generally expected when the operator issues a ticket.

In another embodiment of the disclosure, the paper position detection means of the foregoing ticket production device detects change in the position of the recording paper across the width of the recording paper.

In this configuration, the paper position detection means detects change in the position of the recording paper even when the operator lifts the recording paper diagonally to the paper width to issue a ticket. More specifically, the ability to detect change in the position of the recording paper can be improved.

In another embodiment of the disclosure, the paper position detection means of the foregoing ticket production device detects change in the position of the recording paper in a time based sequence.

In this configuration, the paper position detection means can detect change in the position of the recording paper on a time line, that is, at plural times with a specific interval therebetween. The paper cutting means can then be operated and a ticket produced based on the results. As a result, mistakenly operating the paper cutting means due to chattering of the detection means, paper jams, or unusual momentary movement of the recording paper because of the paper feed load can be prevented.

In another embodiment of the disclosure, the foregoing ticket production device has a period when the detection result of the paper position detection means is ignored.

In this configuration, the detection result of the paper position detection means is ignored and the cutting operation can be prevented at specific times such as during the printing operation and during the paper conveyance operation. As a result, mistaken operation of the paper cutting means can be reduced.

Another embodiment of the disclosure is a ticket production method that cuts by a paper cutting means continuous recording paper on which information was printed by a printing means and issues a ticket from a paper exit, including: a recording paper position change detection step that detects by a paper position detection means change in the position of the recording paper at the paper exit; a paper cutting decision step that determines by a control means whether or not to operate the paper cutting means and cut the recording paper based on the detection result of the paper position detection step; and a paper cutting step that operates the paper cutting means and cuts the recording paper to a desired length when the paper cutting decision step decides to cut the recording paper.

This method enables pausing recording paper printed with information at the paper exit, and when the operator lifts the recording paper intending to issue a ticket, a change in the position of the recording paper can be detected. Whether or not to cut the recording paper can be decided in the paper cutting decision step based on the result from the paper position detection step. The recording paper can then be cut based on the result of this decision. More specifically, tickets can be produced one at a time synchronized to the timing when the operator issues a ticket. As a result, any issued tickets accumulating at the paper exit or falling out of the paper exit can be reduced. Tickets can therefore be conveniently produced.

In another embodiment of the disclosure, the paper position detection step in the above ticket production method detects change in the position of the recording paper at least in a direction intersecting the conveyance direction of the recording paper.

Using this method, the recording paper moving in a direction intersecting the conveyance direction of the recording paper, which is the operation generally expected when the operator issues a ticket, can be detected in the paper position detection step.

In another embodiment of the disclosure, the paper position detection step in the above ticket production method detects a change in the position of the recording paper across the width of the recording paper.

Using this method, a change in the position of the recording paper can be detected in the paper position detection step even when the operator lifts the recording paper diagonally across the paper width to issue a ticket. More specifically, the ability to detect a change in the position of the recording paper can be improved.

In another embodiment of the disclosure, the paper position detection step in the above ticket production method detects a change in the position of the recording paper in a time-based sequence.

Using this method, a change in the position of the recording paper can be detected on a timeline, that is, at multiple times within a specific interval. The paper cutting means can then be operated and a ticket can be produced based on the results. Thus, mistakenly operating the paper cutting means due to chattering of the detection means, paper jams, or unusual momentary movement of the recording paper because of the paper feed load can be prevented.

In another embodiment of the disclosure, the paper cutting decision step in the above ticket production method has a condition to ignore the detection result of the paper position detection step.

Using this method, the detection result of the paper position detection step is ignored and the cutting operation can be prevented at specific times such as during the printing operation and during the paper conveyance operation. As a result, mistaken operation of the paper cutting means can be reduced.

DETAILED DESCRIPTION

An embodiment of the present disclosure is described below with reference to the accompanying figures. Note that in the figures referenced below the horizontal and vertical scale of members and parts may differ from the actual scale for convenience of description and illustration.

General Configuration of a Ticket Production System

Figure 1:
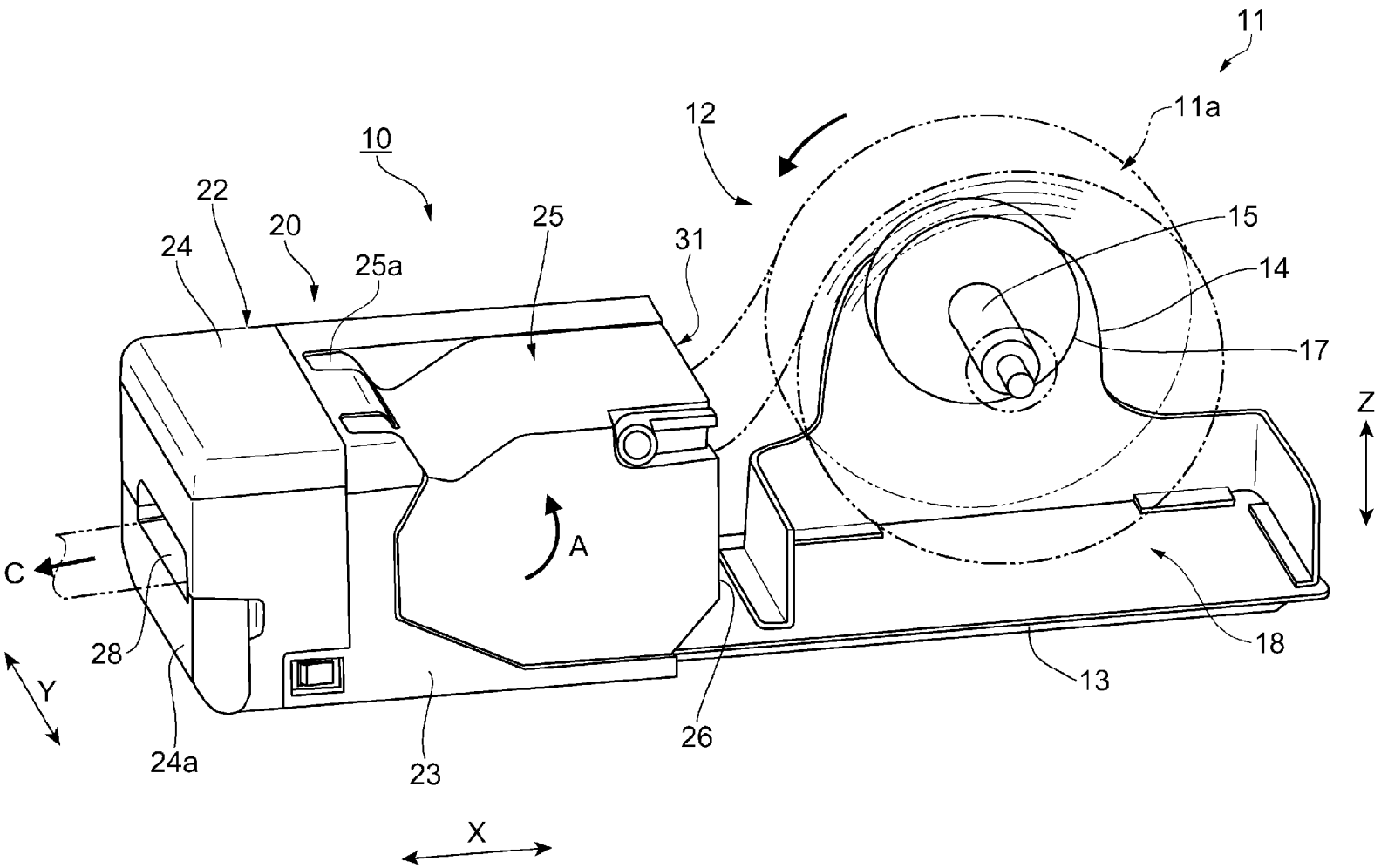
FIG. 1 schematically illustrates a ticket production system using a ticket production device.

A ticket production system using a ticket production device according to this embodiment of the disclosure is described with reference to FIG. 1. FIG. 1 schematically shows a ticket production system using a ticket production device according to this embodiment of the disclosure. The x-axis in FIG. 1 denotes the conveyance direction of the recording paper used in the ticket production system, and the y-axis denotes the direction of the recording paper width. The z-axis is the vertical axis perpendicular to the x-axis and y-axis.

As shown in FIG. 1, the ticket production system 10 includes a paper feed unit 12 and a printer 20 as a ticket production device. The paper feed unit 12 has a base plate 13 that is removably connectable to the printer 20. A paper holder 14 attached to the base plate 13 is enclosed on three sides in a rectangular shape on the base plate 13 side with the long side of the rectangle rising vertically. A roll paper spindle 15 is attached horizontally to a place at the top of the long side of the paper holder 14.

The paper feed unit 12 can supply either roll paper 11*a* comprising continuous recording paper wound in a roll, or fanfold paper not shown having continuous recording paper folded and stacked in sheets of a specific length, selectively stored therein as the recording paper 11.

When roll paper 11*a* is used, the roll paper 11*a* is installed from the distal end of the roll paper spindle 15. A round spacer 17 for adjusting to the roll paper 11*a* width is removably installed at the base of the roll paper spindle 15, and different widths of roll paper 11*a* can be installed referenced to the front open side as seen in FIG. 1.

When fanfold paper is used, the fanfold paper is stored in the rectangular space 18 formed by the base plate 13 and paper holder 14.

The recording paper 11 is used to print baggage tags and boarding passes such as those used in airports, for example. In the case of roll paper 11*a*, label paper having labels of a specific length affixed along the length of a liner of a constant width, for example, is used. In the case of fanfold paper, individual baggage tags or boarding passes (paper) are folded together in a stack. Baggage tags and boarding passes (tickets) may be printed one at a time, or multiple slips could be printed continuously when the passenger has flight transfers or there is a group of people. An RFID tag storing specific information may also be embedded in the leading end portion of the label paper. The recording paper 11 may also be card stock.

Main Printer Configuration

Figure 2:
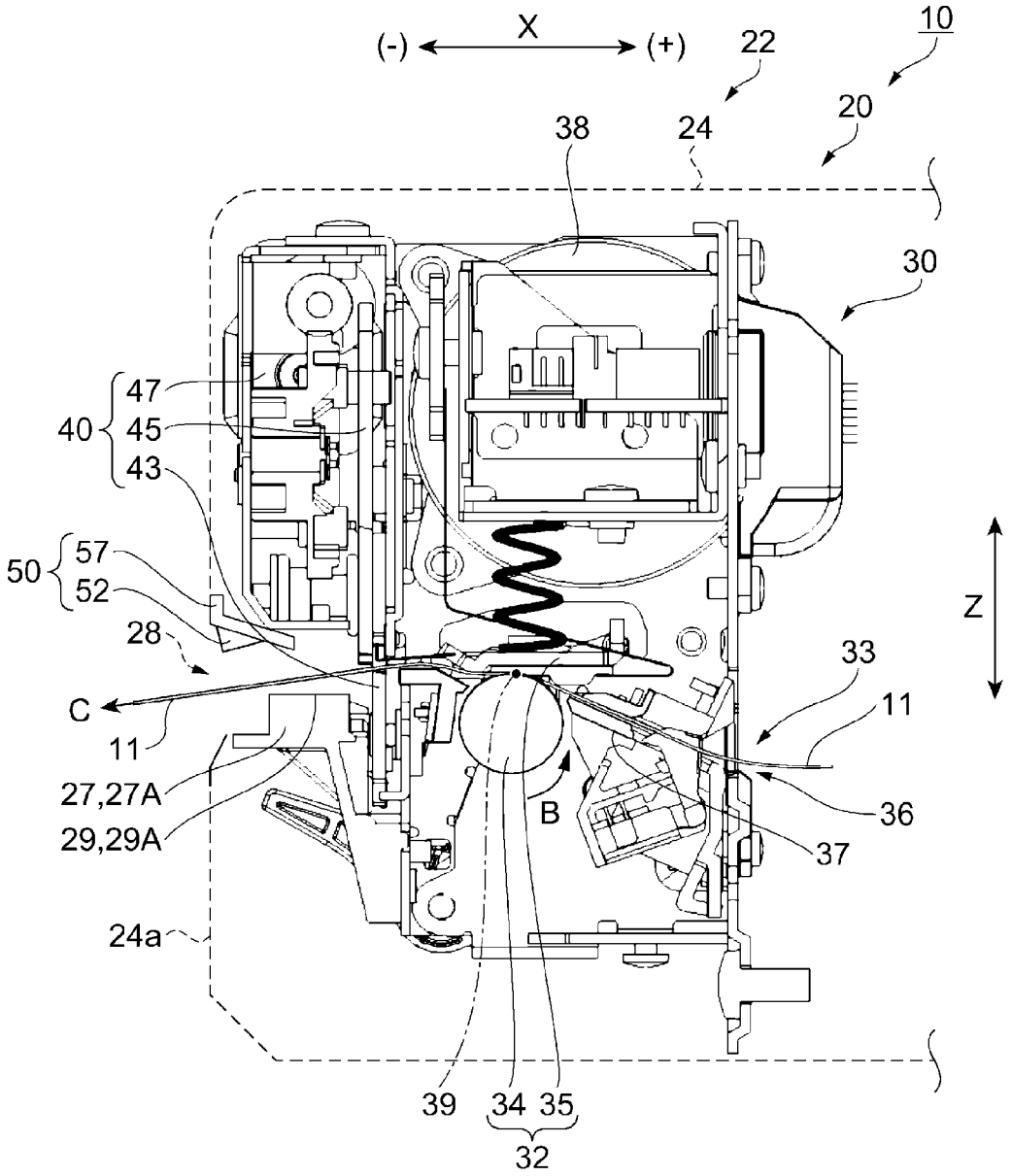
FIG. 2 is a section view showing the main configuration of the print mechanism.
Figure 3:
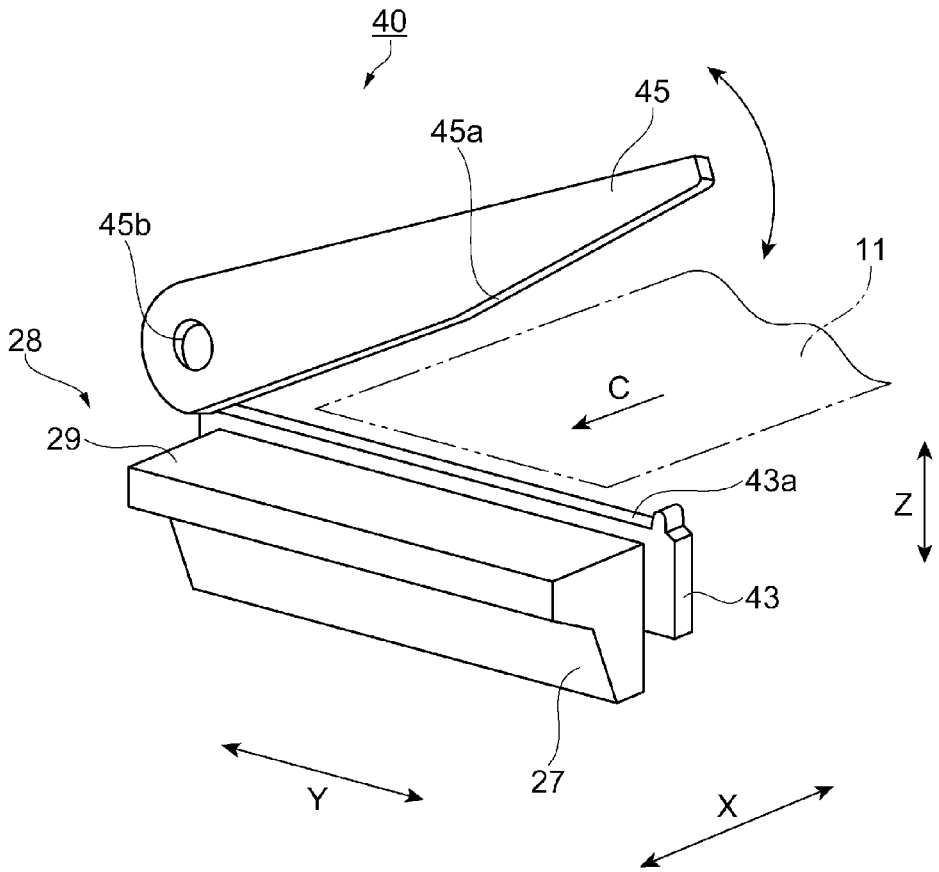
FIG. 3 shows the area around the automatic cutter used as a paper cutting means.

A printer according to another embodiment of the disclosure is described in FIG. 1 through FIG. 3. FIG. 2 is a section view showing the main part of the print mechanism 30, and is a section view of the area near the paper exit. FIG. 3 describes the area around the automatic cutter used as the paper cutting means. The x-axis and z-axis in FIG. 2 and FIG. 3 indicate the same directions as the x-axis and z-axis in FIG. 1. Note that a thermal printer that prints information on thermal recording paper (recording paper 11) is described below.

The printer 20 shown in FIG. 1 has an outside case 22, a print mechanism 30 (see FIG. 2), and a control unit (not shown). The outside case 22 is box-shaped having a length along the x-axis. The outside case 22 includes a main case 23, a front case 24, a cover 25, and a rear case 26. The main case 23 is the base of the outside case 22, and has other case members and the paper feed unit 12 (described below) attached thereto in addition to the outside case 22.

The front case 24 is attached to the main case 23 at the opposite end of the printer 20 as the paper feed unit 12. A rectangular paper exit 28 having a length along the y-axis direction is formed to the front 24*a* of the front case 24 as viewed from the x-axis perspective. The print mechanism 30 (described below) is housed inside the front case 24.

The cover 25 covers the paper feed path 33 of the roll paper 11*a*, and can open and close in the direction of arrow A pivoting on the end 25*a* at the front of the printer 20. The inside of the cover 25 functions to guide the recording paper 11, and may also house a reader (not shown) that reads information stored in the RFID tag noted above, for example. The rear case 26 is disposed to the paper feed unit 12 side of the printer 20, and has a rectangular paper entrance 31 that is long in the y-axis direction formed substantially opposite the paper exit 28 in the front case 24.

As shown in FIG. 2, the print mechanism 30 is housed inside the front case 24 of the outside case 22, and includes a paper conveyance means 32, printing means 35, an automatic cutter 40 as a paper cutting means, and a paper position detection means 50. The paper conveyance means 32 conveys continuous recording paper 11 through the paper feed path 33 inside the printer 20. The paper conveyance means 32 includes a platen roller 34 disposed to a specific position on the paper feed path 33, and a thermal printhead 35 is disposed opposite platen roller 34. Because a thermal printer is used as an example of the printer in this embodiment, the paper conveyance means 32 also functions to print information on recording paper 11.

A paper entrance 36 to the print mechanism 30 is formed at the (+) x-axis side of the paper conveyance means 32. The recording paper 11 is supplied through this paper entrance 36 into the printer, and is held with pressure applied thereto between the thermal printhead 35 and platen roller 34. A paper guide 37 for guiding the recording paper 11 is disposed to the paper feed path 33 on the upstream side from the paper entrance 36 to the thermal printhead 35 and platen roller 34.

Drive torque from a paper feed motor 38 is transferred through a geared transmission mechanism (not shown), for example, to the platen roller 34. When the platen roller 34 turns forward (direction of arrow B in FIG. 2), the recording paper 11 is conveyed forward (from the (+) x-axis side to the (−) x-axis side) via rotation through the paper feed path 33. When the platen roller 34 turns in reverse (opposite the direction of arrow B), the recording paper 11 is reversed. Note that the conveyance direction that feeds the recording paper 11 toward the paper exit 28 (the conveyance direction of the recording paper 11 when printing, indicated by arrow C in FIG. 1 and FIG. 2) is the normal conveyance direction.

The thermal printhead 35 has a heat unit 39 for heating the recording paper 11 and printing disposed to the side facing the platen roller 34. This heat unit 39 is formed in a line in the y-axis direction. When printing, the heat unit 39 part of the thermal printhead 35 is set opposite the platen roller 34, and the desired heat elements in the group of plural heat elements constituting the heat unit 39 are selectively heated while conveying the recording paper 11 between the heat unit 39 and platen roller 34. Because the surface of the recording paper 11 is coated with a thermal coating, the part heated by a driven heat element changes color. This is controlled by a control unit (not shown), and information is printed on the surface of the recording paper 11 based on the print data.

The recording paper 11 on which information is printed then passes the automatic cutter 40 and paper position detection means 50 described below, and is discharged to the outside from the paper exit 28 on the (−) x-axis side of the print mechanism 30. At this time, the recording paper 11 is paused at the paper stage 27 disposed below the paper exit 28 on the z-axis.

The automatic cutter 40 can cut the continuous recording paper 11 to the desired length. A scissor-type automatic cutter that pivots one blade in the direction to and away from another blade is described as an example of the automatic cutter 40 in this embodiment of the disclosure. Note that there are multiple types of automatic cutters 40, including guillotine type cutters that move one blade to and away from another blade with a reciprocating linear motion, and any type of cutter can be used.

As shown in FIG. 2 and FIG. 3, the automatic cutter 40 includes a fixed knife 43, a movable knife 45, a cutter drive motor 47, and a movable knife drive transmission mechanism (not shown). The fixed knife 43 is a basically rectangular blade with a straight cutting edge 43*a* formed on one long side. The fixed knife 43 is affixed with the cutting edge 43*a* extending on the y-axis below the paper feed path 33 on the z-axis. The movable knife 45 is a blade with a substantially straight cutting edge 45*a* formed on one long side, and has a pivot axis 45*b* near one end. The pivot axis 45*b* is located on the y-axis outside the range of recording paper 11 travel.

The automatic cutter 40 has a cutter drive motor 47, and drive power from the cutter drive motor 47 is transmitted through a movable knife drive transmission mechanism (not shown) to the movable knife 45. As a result, the movable knife 45 can pivot on pivot axis 45*b*, and by operating the cutter drive motor 47 the movable knife can pivot toward and away from fixed knife 43. As a result, the recording paper 11 set between the fixed knife 43 and movable knife 45 is cut. Note that a ticket of desired length can be produced by synchronizing operation of the automatic cutter 40 with the paper feed operation of the paper conveyance means 32.

The paper stage 27 is made from a suitable material such as plastic, and as shown in FIG. 2 and FIG. 3, is disposed spanning the gap between the paper conveyance means 32 and the front case 24 of the outside case 22, thereby forming part of the surface of the paper feed path 33 over which the recording paper 11 slides. The paper stage 27 has a rectangular paper guide surface 29 of which the long side is in the paper width direction (y-axis) of the paper feed path 33, and the short side is in the paper conveyance direction (x-axis). The top of the paper guide surface 29 is slightly lower on the z-axis than the position of the cutting edge 43*a* of fixed knife 43. The paper guide surface 29 functions to guide the bottom of the recording paper 11 conveyed through the paper feed path 33.

Recording Paper Position Detection Means

Embodiment 1

Figure 4:
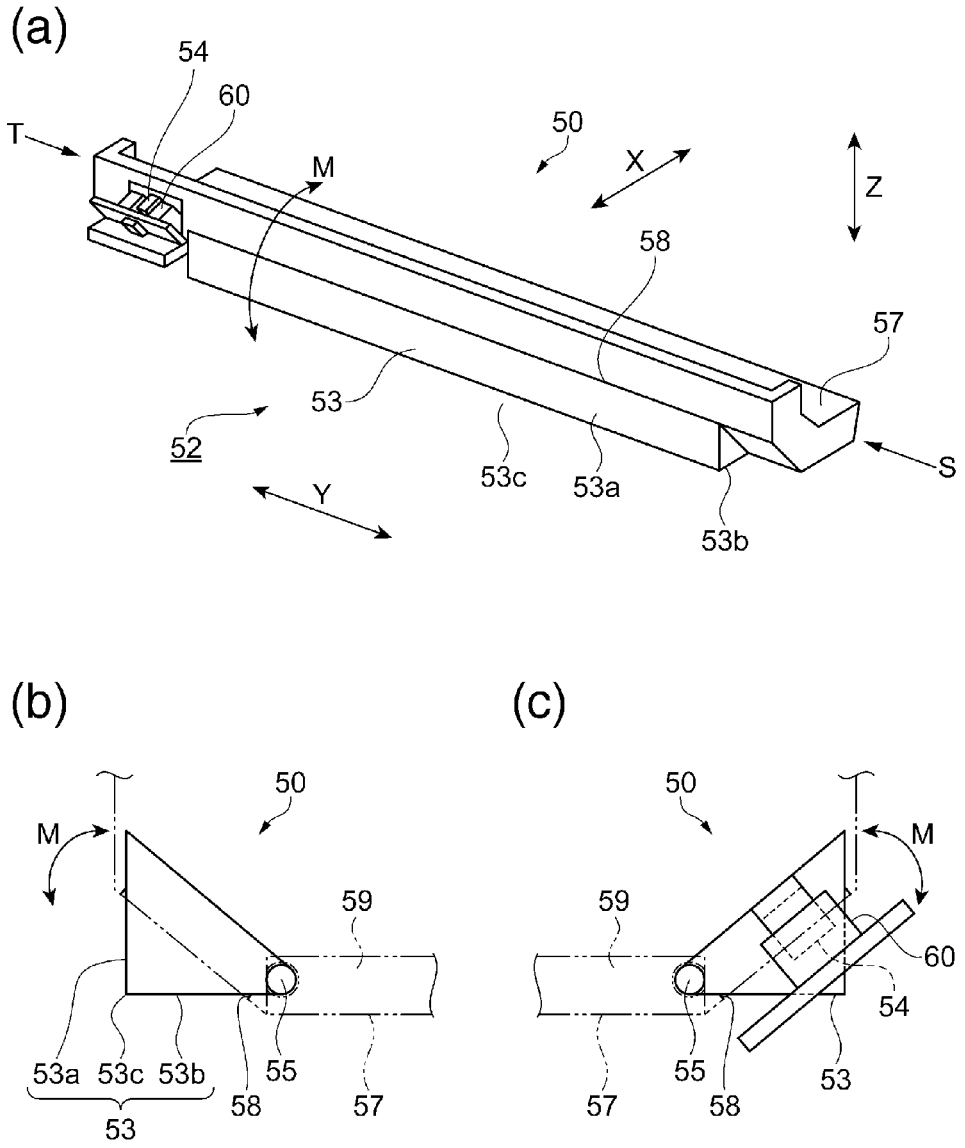
FIG. 4 illustrates the paper position detection means according to a first embodiment of the disclosure.

A recording paper position detection means according to the first embodiment of the disclosure is described below with reference to FIG. 2 and FIG. 4. FIG. 4 describes the paper position detection means according to the first embodiment of the disclosure, (a) being an oblique view from the paper discharge direction, (b) being a schematic view from the direction of arrow S in (a), and (c) being a schematic view from the direction of arrow T in (a). The x-axis, y-axis, and z-axis in FIG. 4 are the same as the x-axis, y-axis, and z-axis in FIG. 1.

As shown in FIG. 2, the paper position detection means 50 is disposed to the paper exit 28 in the outside case 22 opposite the paper guide surface 29 of the paper stage 27 described above, and in a position facing the printing surface of the printed recording paper 11 paused at the paper guide surface 29. As shown in FIG. 4, the paper position detection means 50 has a detection lever 52, a detection lever support 57, and a detector 60.

The detection lever 52 is made of plastic or other desirable material, and has a sensing part 53, an interrupter 54, and a support shaft 55. The sensing part 53 is the main part of the detection lever 52, and is triangular in section with two rectangular sides 53*a*, 53*b*, of which the side on the y-axis in FIG. 4 is the long side with a length substantially equal to or greater than the width of the recording paper 11, joined at a single peak 53*c*. Two support pins 55 are formed extending from ends of the long side opposite of the peak 53*c* on the one side 53*b*. A substantially rectangular interrupter 54 is formed projecting from one end on the y-axis.

As shown in FIG. 2, the detection lever support 57 forms the top on the z-axis in FIG. 1 of the paper exit 28 formed in the front case 24. A rectangular opening 58 with the long side on the y-axis is formed in the detection lever support 57. The sensing part 53 is fit into this opening 58. Support pin bearings 59 are disposed to positions that correspond to the two support pins 55 of the detection lever 52 when the sensing part 53 is fit into the opening 58. As a result, the detection lever 52 can pivot on the two support pins 55 in the direction (arrow M in the figure) in with the peak 53*c* of the sensing part 53 at the vertex moves in and out from the opening 58 in the detection lever support 57.

A detector 60 with a sensing part in the range of movement of the interrupter 54 is disposed at one end when the detection lever 52 pivots on the support pins 55 is disposed to the detection lever support 57. A transmissive optical sensor, for example, is desirable as the detector 60. The detector 60 has a light-emitting part and a photodetection part, and detects the light emitted from the light-emitting part with the photodetection part. The detector 60 outputs a signal according to whether or not light is detected by the photodetection part, or the amount of light received by the photodetection part. As a result, sensor output changes and operation of the detection lever 52 is detected according to whether or not the interrupter 54 crosses the optical axis of the detector 60.

Method of Detecting the Paper Position

A paper position detection method is described next referring to FIG. 4. The recording paper 11 on which information was printed by the print mechanism 30 described above is conveyed by the paper feed mechanism 32 until the position of the trailing end of the paper when issued as a ticket reaches the cutting position of the automatic cutter 40, and is then paused on the paper stage 27.

The operator then lifts the printed recording paper 11 when the operator wants to issue the ticket, for example. The recording paper 11 raised from the paused position contacts the sensing part 53 (the peak 53*c* part) of the detection lever 52 of the paper position detection means 50. When the recording paper 11 is raised further, the sensing part 53 of the detection lever 52 in contact with the recording paper 11 pivots on the two support pins 55 and rotates in the direction of arrow M. The interrupter 54 formed in unison with the detection lever 52 therefore also pivots. As a result, the interrupter 54 moves out of the optical axis of the detector 60 of the paper position detection means 50, and the output of the detector 60 changes.

By detecting this change in output, change in the position of the recording paper 11 paused on the paper stage 27 can be detected. Note that the length on the y-axis of the sensing part 53 is substantially the same length as the width of the recording paper 11. As a result, the detection lever 52 can still pivot even if the operator twists or lifts the recording paper 11 at an angle to the paper width, and change in the position of the recording paper 11 can be detected.

Ticket Production Method

Figure 5:
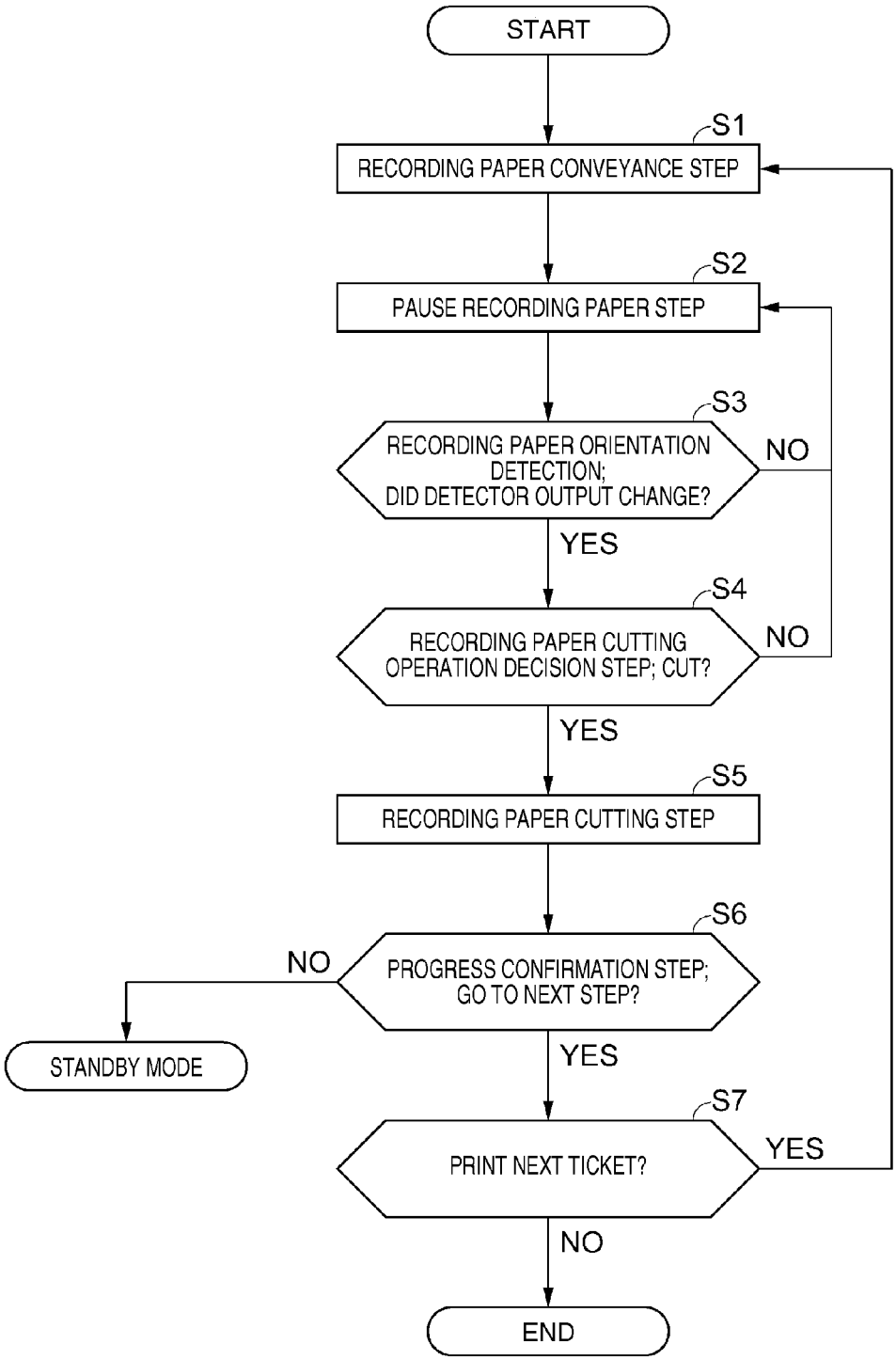
FIG. 5 is a flow chart of ticket production.

A ticket production method is described below with reference to FIG. 5. FIG. 5 is a flow chart showing the flow of ticket production, and is executed by a control means not shown comprising a CPU and memory, for example, inside the ticket production device.

In the recording paper conveyance step S1 shown in FIG. 5, the paper feed mechanism 32 and printing means 35 of the printer 20 shown in FIG. 2 print the desired information on the recording paper 11.

In the pause recording paper step S2, the recording paper 11 on which information was printed is paused on the paper stage 27 of the paper exit 28 shown in FIG. 2. At this time, the position of the trailing end of the recording paper 11 when issued as a ticket is aligned with the cutting position of the automatic cutter 40.

In the recording paper position detection step S3, change in the position of the recording paper 11 on the paper stage 27 is detected using the paper position detection means 50 shown in FIG. 4. The output of detector 60 that occurs when the position of the recording paper 11 on the paper stage 27 of the paper exit 28 changes and the detection lever 52 is monitored. If the output of the detector 60 changes (YES), control goes to the next step. If the output of the detector 60 does not change (NO), operation waits in the pause recording paper step S2.

In the recording paper cutting operation decision step S4, whether or not to operate the automatic cutter 40 and cut the recording paper 11 waiting on the paper stage 27 is determined based on the detection result of the recording paper position detection step S3. Examples of the decision standard are described below. For example, the detection result is ignored and the recording paper 11 is not cut during the printing operation of the printer 20 or until the end of printing is detected. The printing operation can be detected when print data is being received, for example. The end of printing can be detected, for example, by receiving an end-of-printing status command, when a print command is not received for a specific time or more, or by communication of a specific command, such as when a cut command is received.

The detection result is ignored while the printer 20 is conveying paper and during specific operations accompanying paper conveyance, and when a command is received. In addition, change in the output of detector 60 is checked at a specific interval or at multiple times within a specific period, and if an irregular change in output or change in the on/off status is confirmed, the detection result is ignored and the recording paper 11 not cut. In other words, the printer 20 determines whether to operate the automatic cutter 40 and cut the recording paper 11 when the operator intentionally changing the position of the recording paper 11 to issue a ticket can be confirmed.

If it is determined that the paper is to be cut (YES), control goes to the next step. If it is determined that the paper is not to be cut (NO), printer 20 returns to the pause recording paper step S2 and waits. In the recording paper cutting step S5, printer 20 operates the automatic cutter 40, cuts the recording paper 11 waiting at the paper stage 27 to a desired length, and produces a ticket.

In the progress confirmation step S6, whether to proceed to the next step is determined. This step confirms, for example, whether the produced ticket was actually removed, and whether the state enabling feeding the recording paper 11 and starting printing was resumed. This decision is made based on whether output of the detector 60 is positively ON or OFF, or if the change in output is within an expected range. Whether or not the cutting operation of the automatic cutter 40 was actually executed is also determined. This decision confirms whether the movable knife 45 moved to a specific position and reset to the home position using a position sensor, for example, that checks driving the movable knife 45 of the automatic cutter 40. If proceeding to the next step is confirmed (YES), operation goes to the next step. If proceeding to the next step is denied (NO), a problem may have occurred and a standby mode is entered. An error can also be displayed in this event.

Whether or not there is a next ticket to produce is determined in the next step S7. If there is a next ticket to produce (YES), control returns to the recording paper conveyance step S1 and the above operation repeats. If there is not a next ticket to produce (NO), the ticket production operation ends.

The effect of this embodiment is described below.

(1) When recording paper 11 on which information was printed is paused at the paper exit 28, and the operator lifts the recording paper 11 intending to issue a ticket, the printer 20 described as a ticket production device above can detect change in the position of the recording paper 11 by the paper position detection means 50. Based on the detection result of the paper position detection means 50, the recording paper 11 can then be cut by the automatic cutter 40 to produce a ticket. Tickets can therefore be produced one at a time synchronized to when the operator issues a ticket. As a result, issued tickets being left in the paper exit 28 or falling away from the paper exit 28 can be reduced. A printer 20 that is easy to use can therefore be provided.

(2) The detection lever 52 of the paper position detection means 50 in the printer 20 described above has a width substantially equal to the width of the recording paper 11, and pivots in a direction intersecting the conveyance direction of the recording paper 11. The paper position detection means 50 can therefore detect moving the recording paper 11 in the direction intersecting the conveyance direction of the recording paper 11, which is generally expected in the ticket issuing operation of the operator, and can detect change in the position of the recording paper 11 even if the operator raises the recording paper 11 at an angle to the paper width direction in the ticket issuing operation. More specifically, a printer having a paper position detection means 50 with good detection performance can be provided.

(3) In the printer 20 used as the ticket production device and the ticket production method described above, the control unit or the recording paper cutting operation decision step S4 determines whether or not to operate the automatic cutter 40 and cut the recording paper 11 waiting at the paper stage 27 based on the detection result of the paper position detection means 50 or the recording paper position detection step S3. For example, the paper position detection means 50 detects change in the position of the recording paper 11 on a time basis, that is, at multiple times or during a specific interval, and makes a decision based on the detection result. As a result, mistakenly operating the automatic cutter 40 due to momentary movement of the recording paper 11 because of the paper feed load, paper jams, or chattering of the paper position detection means 50 can be reduced.

A period during which the detection result of the paper position detection means 50 is disabled can also be provided. More specifically, the detection result from the paper position detection means 50 can be ignored and the cutting operation not performed at specific times during the printing operation and during the paper feed operation. As a result, mistaken operation of the automatic cutter 40 can be reduced.

(4) The ticket production method described above has a progress confirmation step S6 that confirms whether to proceed to the next step (such as printing the next ticket) when operation of the automatic cutter 40 ends. More specifically, if the produced ticket was actually removed from the paper exit 28, if conveying and printing on the recording paper 11 can start, or if the cutting operation of the automatic cutter 40 was successful, for example, could be confirmed. Problems when producing the next ticket due to a problem with the printer 20 or incorrectly loading a ticket or recording paper 11 can therefore be reduced.

Recording Paper Position Detection Means

Embodiment 2

Figure 6:
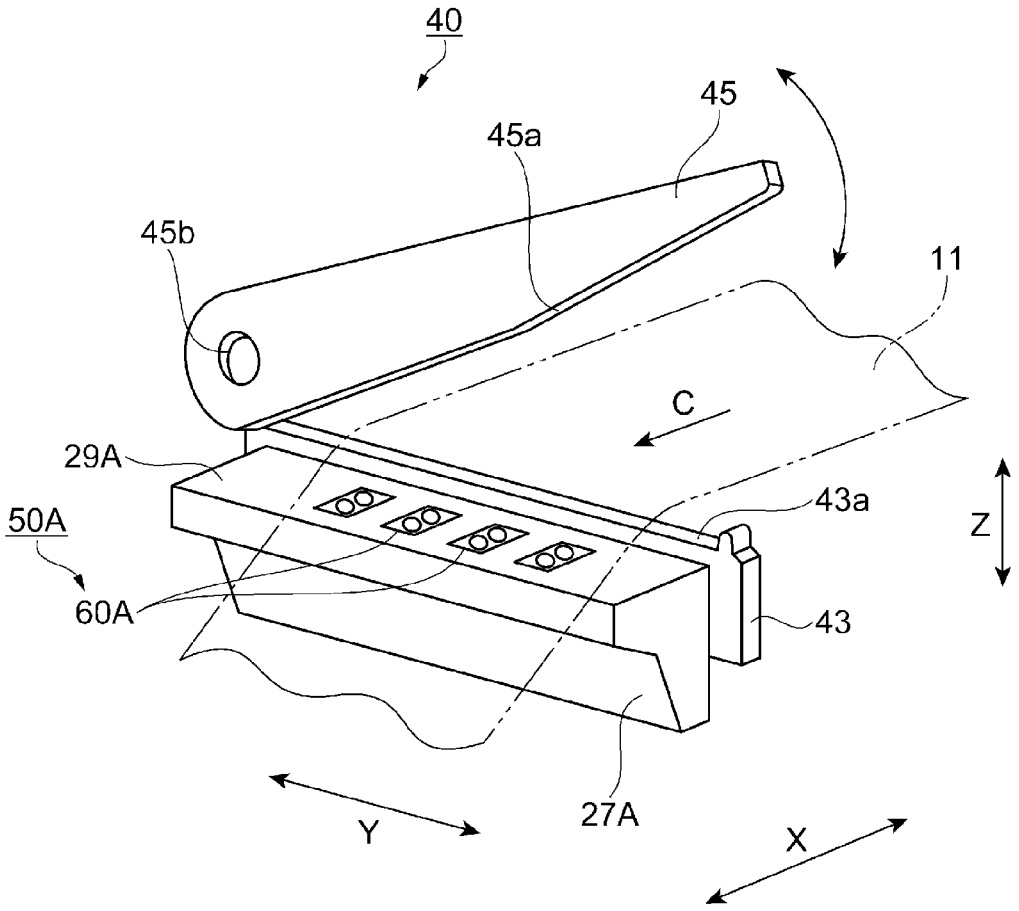
FIG. 6 illustrates the paper position detection means according to a second embodiment of the disclosure.

A recording paper position detection means according to a second embodiment of the disclosure is described next with reference to FIG. 6. The x-axis, y-axis, and z-axis in FIG. 6 are the same as the x-axis, y-axis, and z-axis in FIG. 1. Note that aspects of the configuration and content that are the same as in the first embodiment are identified by like reference numerals, and further description thereof is omitted.

As shown in FIG. 6, the paper position detection means 50A according to the second embodiment of the disclosure has a plurality of detectors 60A disposed to the paper guide surface 29A of the paper stage 27A in a line across the full paper width in the direction of the paper width of the recording paper 11. As a result, the plural detectors 60A face the back side of the printed recording paper 11 resting on the paper stage 27A. The detectors 60A are desirably reflective optical sensors. Each detector 60A has a light-emitting part and a photodetection part, and the light emitted from the light-emitting part is reflected by the back of the recording paper 11 on the paper stage 27A and detected by the photodetection part. The detector 60A outputs a signal according to whether or not light is detected by the photodetection part, or the amount of light received by the photodetection part.

Whether recording paper 11 is on the paper stage 27A can therefore be detected by observing the output of detectors 60A. A change in the distance between the paper guide surface 29A and the back of the recording paper 11 can also be detected by observing the output of the detectors 60A.

Method of Detecting the Paper Position

The paper position detection method using a paper position detection means according to the second embodiment of the disclosure is described next referring again to FIG. 6. The recording paper 11 on which information was printed by the print mechanism 30 described above is conveyed by the paper feed mechanism 32 until the position of the trailing end of the paper when issued as a ticket reaches the cutting position of the automatic cutter 40, and is then paused on the paper stage 27A.

The operator then lifts the printed recording paper 11 when the operator wants to issue the ticket, for example. The back of the recording paper 11 raised from the paused position gradually separates from the paper guide surface 29A. More specifically, the distance between the paper guide surface 29A and the back of the recording paper 11 increases. As a result, the output of the detector 60A of the paper position detection means 50A changes.

By detecting this change in output, a change in the position of the recording paper 11 paused on the paper stage 27 can be detected. Note that detectors 60A are disposed across the full width of the recording paper 11. As a result, a change in the position of the recording paper 11 can be detected by observing output of the detectors 60A even if the operator twists or lifts the recording paper 11 at an angle to the paper width.

The effect of the second embodiment of the disclosure is described below.

(1) Detectors 60A of the paper position detection means 50A in the printer 20 can detect movement of the recording paper 11 in the direction intersecting the conveyance direction of the recording paper 11 and can detect change in the position of the recording paper 11 if the operator raises the recording paper 11 at an angle to the paper width direction in the ticket issuing operation. Thus, a printer 20 having a paper position detection means 50A with good detection performance can be provided. Whether recording paper 11 is on the paper stage 27A can also be detected.

Embodiments of the disclosure are described above and can be modified in many ways without departing from the scope of the disclosure. Examples of such modifications are described below.

A thermal printer is used as an example of a printer 20 in the embodiments described above, but the disclosure is not so limited. The printer 20 could be an inkjet printer or a dot impact printer, for example.

What is claimed is:

1. A ticket production device configured to cut and issue a continuous recording paper on which information is printed as a ticket from a paper exit, comprising:

a paper feeding mechanism configured to convey the recording paper through a paper conveyance path;

a print mechanism configured to print information on the recording paper conveyed by the paper feeding mechanism;

a paper cutter configured to cut the recording paper printed with information into a ticket of a specific length;

a paper position detector configured to detect a change of the recording paper in a waiting position of the recording paper conveyed by the paper feeding mechanism to a position of a trailing end of the recording paper after the paper is fully in the waiting position; and a controller configured to control the paper cutter;

wherein the paper position detector is configured to detect whether the recording paper in the waiting position changed, and the controller is configured to operate the paper cutter to cut the trailing end of the recording paper when the paper position detector detects the change of the recording paper after the paper is fully in the waiting position and to produce the ticket.

2. A ticket production device configured to cut and issue a continuous recording paper on which information is printed as a ticket from a paper exit, comprising:

a paper feeding mechanism configured to convey the recording paper through a paper conveyance path;

a print mechanism configured to print information on the recording paper conveyed by the paper feeding mechanism;

a paper cutter configured to cut the recording paper printed with information into a ticket of a specific length;

a paper position detector-configured to detect a change of the recording paper in a waiting position of the recording paper conveyed by the paper feeding mechanism to a position of a trailing end of the recording paper; and a controller configured to control the paper cutter;

wherein the paper position detector is configured to detect whether the recording paper in the waiting position changed, the controller is configured to operate the paper cutter to cut the trailing end of the recording paper when the paper position detector detects the change of the recording paper and to produce the ticket, and the paper position detector is configured to detect change in the waiting position of the recording paper at least in a direction intersecting the conveyance direction of the recording paper.

3. The ticket production device described in claim 1, wherein the paper position detector is configured to detect change in the waiting position of the recording paper across the width of the recording paper.

4. The ticket production device described in claim 1, wherein the paper position detector is configured to detect change in the waiting position of the recording paper in a time based sequence.

5. The ticket production device described in claim 1 , wherein there is a period when the detection result of the paper position detector is ignored.

6. A ticket production method that cuts by a paper cutter a recording paper on which information was printed by a printing mechanism and issues a ticket from a paper exit, comprising:

feeding the recording paper, having the information printed thereon, to a position of a trailing end of the recording paper;

waiting during a period in which the recording paper is held in a waiting position;

detecting, by a paper position detector, a change of the recording paper in the waiting position of the recording paper at the paper exit; and cutting the recording paper when the paper position detector detects the change of the recording paper in the waiting position.

7. The ticket production method described in claim 6, the method further comprising detecting the change of the recording paper in the waiting position of the recording paper at least in a direction intersecting the conveyance direction of the recording paper.

8. The ticket production method described in claim 6, the method further comprising detecting the change of the recording paper in the waiting position of the recording paper across a width of the recording paper.

9. The ticket production method described in claim 6, the method further comprising detecting a change in the position of the recording paper in a time based sequence.

10. The ticket production device described in claim 1, wherein device is configured to detect second movement of the paper while the paper is being conveyed to the waiting position, separate from the movement detected, and prevent the cutter from cutting the paper while the paper is being conveyed even though the paper position detector detects the second movement while the paper is being conveyed.

11. The ticket production device described in claim 1, wherein the device is configured such that the detection of the change in position of the paper occurs after completion of the conveyance of the paper to the waiting position.

12. The ticket production method described in claim 6, wherein the action of detecting is executed after the paper is completely provided to the waiting position.

13. The ticket production method described in claim 6, further including the action of separately detecting, prior to the action of detecting the change of the recording paper in the waiting position, movement of the paper as the paper advances into the waiting position.

14. The ticket production method described in claim 6, wherein the action of cutting the paper is based solely on the detection of the change of the paper.

15. The ticket production device described in claim 2, wherein:

the paper position detector is configured to detect the change of the recording paper in the waiting position of the recording paper conveyed by the paper feeding mechanism to the position of the trailing end of the recording paper after the paper is fully in the waiting position; and the controller is configured to operate the paper cutter to cut the trailing end of the recording paper when the paper position detector detects the change of the recording paper after the paper is fully in the waiting position and to produce the ticket.

16. The ticket production device described in claim 15, wherein the paper position detector is configured to detect change in the waiting position of the recording paper across the width of the recording paper.

17. The ticket production device described in claim 15, wherein the paper position detector is configured to detect change in the waiting position of the recording paper across the width of the recording paper.

18. The ticket production device described in claim 15, wherein the paper position detector is configured to detect change in the waiting position of the recording paper in a time based sequence.

19. The ticket production device described in claim 15, wherein there is a period when the detection result of the paper position detector is ignored.

* * * * *